United States Patent [19]

Jährig et al.

[11] 4,204,103

[45] May 20, 1980

[54] DRIVING APPARATUS FOR ELECTRIC POWER CIRCUIT BREAKERS

[75] Inventors: Siegfried Jährig; Reinhard Liebig, both of Berlin, Fed. Rep. of Germany

[73] Assignee: Siemens Aktiengesellschaft, Berlin and Munich, Fed. Rep. of Germany

[21] Appl. No.: 943,926

[22] Filed: Sep. 20, 1978

[30] Foreign Application Priority Data

Sep. 20, 1977 [DE] Fed. Rep. of Germany ..... 2742772

[51] Int. Cl.[2] ..... H01H 5/10

[52] U.S. Cl. ..... 200/153 SC; 200/153 H; 335/76

[58] Field of Search ..... 200/48 A, 153 SC, 153 H, 200/335, 337; 335/76, 171

[56] References Cited

U.S. PATENT DOCUMENTS

| | | | |
|---|---|---|---|
| 1,938,408 | 12/1933 | Thumim | 335/76 |
| 2,394,046 | 2/1946 | Dickinson | 200/153 H |
| 3,097,275 | 7/1963 | Wiktor | 200/153 SC |
| 3,823,290 | 7/1974 | Caton | 200/153 SC |

FOREIGN PATENT DOCUMENTS

| | | | |
|---|---|---|---|
| 511515 | 4/1955 | Canada | 200/153 H |
| 1490338 | 12/1968 | Fed. Rep. of Germany | 200/153 SC |

*Primary Examiner*—Richard R. Stearns
*Attorney, Agent, or Firm*—Kenyon & Kenyon

[57] ABSTRACT

A driving apparatus is disclosed for electric power circuit breakers having power accumulator springs which engage a shaft by means of a crank arm. The power accumulator springs are arranged in two groups, each of which consists of several parallel-connected coil springs. These two groups engage opposed crank arms carried on the shaft, shifted by 180°. The driving device allows storage of a relatively large amount of energy in little space and is distinguished by a shock- and vibration-free motion cycle.

5 Claims, 3 Drawing Figures

3
61
65
7
1
2
54
8
55
43
56
60
51
62
5
64
63

DRIVING APPARATUS FOR ELECTRIC POWER CIRCUIT BREAKERS

BACKGROUND OF THE INVENTION

This invention relates to a driving apparatus for electric power circuit breakers having power accumulator springs which engage a shaft by means of a crank arm and can be latched in the cocked condition.

A driving apparatus of this kind is described, for instance, in the German Offenlegungsschrift No. 22 36 788. In general, the following switching operations are required of such driving apparatus: immediate closing by means of a closing command at the breaker itself or by remote control in a control room; immediate opening, likewise by a switching command given at the breaker or in a control room; and automatic closing and opening in dependence on protective or safety devices.

Because short interruption is frequently required, the driving apparatus must also be able to reclose the circuit immediately after an interruption and, then, to interrupt it again in case the short interruption did not correct the fault.

The driving energy for these switching actions are stored in springs which can be cocked by a cocking device such as a motor drive. If the driving apparatus is designed so that the energy required for opening the breaker is supplied by the closing springs and transferred to the opening springs during the closing process, then stringent requirements as to energy limits and mechanical reliability are placed on that part of the driving apparatus which contains the closing springs. The larger the electrical switching capacity needed in the power circuit breakers, the harder these requirements are to meet. In particular, the vibrations emanating from the driving apparatus become a considerable problem in the entire breaker since this not only stresses all parts mechanically to a considerable degree, but also can impair the functioning of the more sensitive parts of the power circuit breaker, such as auxiliary switches, relays, contactors, tripping devices and the like.

BRIEF SUMMARY OF THE INVENTION

It is an object of the invention to provide a driving apparatus of the type mentioned which can be constructed in a small space despite increased switching capacity and which will operate free of shock and vibration. This result is achieved by means of two groups of parallel-connected coil springs which engage oppositely extending crank arms, displaced by 180°, on a shaft and by attaching the cocking device for the springs between the crank arms. The parallel-connected springs store much energy in a relatively small space. When these groups of springs move, little imbalance is produced, since the mass forces are substantially balanced with respect to the shaft. With this structure, in addition, the shaft can be made short and strong, since, with the groups of springs out of each other's way, the crank arms and the cocking device, a ratchet wheel for instance, can be arranged with little axial distance needed between them.

The use of parallel-connected coil springs in driving apparatus for power circuit breakers is well known in the art (U.S. Pat. No. 3,723,686). There, however, it was not recognized that only the use of two identical groups of springs, engaging crank arms displaced by 180° on a shaft, would result in a mode of operation with little shock and vibration.

Spring drives are also known in which one coil spring engages each of two opposite crank arms on a shaft (Siemens Operating Instruction SW 8378-220 for Load Disconnect Switch 3 CB). These driving apparatus cannot execute the switching operations described above since they do not store the energy required for power circuit breakers. They therefore do not solve the problem which is met in the driving apparatus of this invention.

Tests have shown that, by using groups of parallel-connected coil springs to drive each crank arm, the driving energy required for medium-voltage power circuit breakers can be made available in a compact space.

Small dimensions and advantageously reduced mechanical stresses are obtained by removal taking off the stored driving energy at one of the crank arms and by supporting the shaft between the crank arms.

Coil compression springs are used for power accumulation in a manner well known in the art. These can be braced between a stationary support and a linearly guided, moving support connected to each one of the crank arms by a tie rod.

The longitudinal axis of the spring arrangement is inclined with respect to the plane of the housing. The inclination need only be a few angular degrees in order to effect better use of the interior of the customarily rectangular housing.

Figure 1:
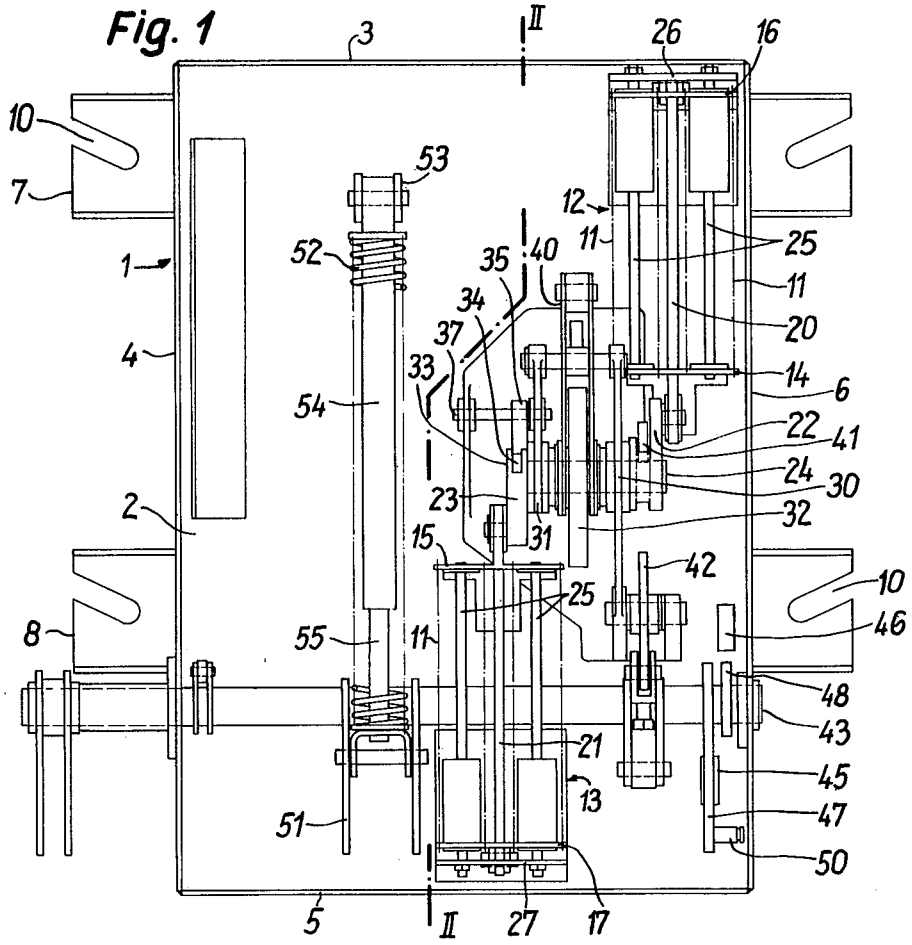
FIG. 1 shows a view of a driving apparatus for a medium-voltage, oilless, power circuit breaker according to the teachings of the invention.

The driving apparatus is accommodated in a housing which has a supporting housing body or part 1 in the shape of a tray having a flat bottom 2 and four side walls 3, 4, 5 and 6. Channel members (profile sections) 7 and 8 are welded to the bottom 2 and serve to anchor pin insulators (not shown) on which the pole columns of the power circuit breaker can be mounted. To this end, the channel members are provided with inclined cutouts 10. As will be explained later on, the driving mechanism is protected against the environment by a covering hood 60.

Since the circuit breaker arrangement consisting of the driving apparatus, the support insulators, and the pole columns is generally known and can be seen, for instance, in the German Auslegeschrift 15 40 439, a showing of the complete power circuit breaker is omitted from this description in the interest of brevity.

The driving apparatus uses the principle of a spring accumulator drive. It comprises two groups 12 and 13 of four coil springs 11, each, which are braced, on the one hand, against stationary supports 14 and 15 and, on the other hand, against movable supports 16 and 17. The movable supports are each connected via tie rods 20 and 21 to crank arms 22 and 23 of a cocking shaft 24. The coil springs 11 and their movable supports 16 and 17 travel on guide rods 25 which extend between the stationary supports 14 and 15 and associated angle brackets 26 and 27, respectively.

Figure 2:
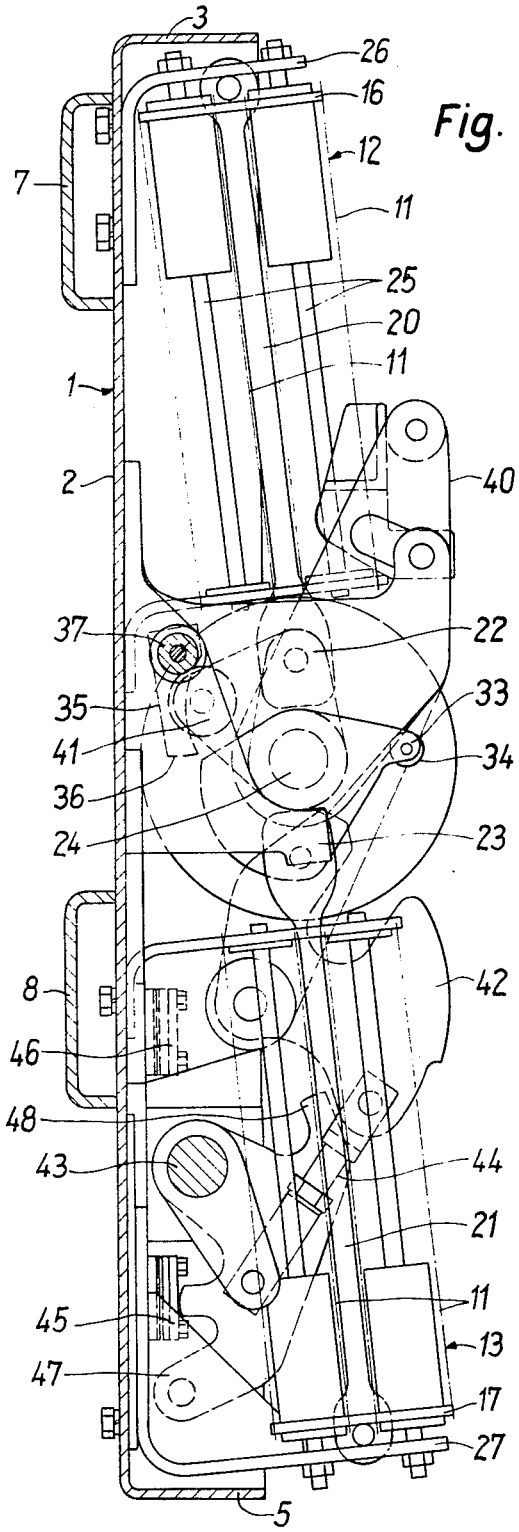
FIG. 2 shows a cross-section along the line II—II in FIG. 1.

In the drawings, the coil springs 11 are shown in released position. It can be seen from FIG. 2 that the longitudinal axis of each spring arrangement is at an angle of several degrees relative to the bottom of the housing part 1 and that the support angle brackets 26 and 27 accordingly have different configurations. By arranging the spring assemblies at an angle, space is created in the driving apparatus for accommodating other parts in the lower part of the driving apparatus.

Starting from the position shown, the cocking shaft 24 can be turned step by step in its bearings 30 and 31 by a ratchet wheel 32 fastened to it, until a lever 33, likewise fastened to the cocking shaft 24, comes to rest with the roller 34, attached to its end, against a stop surface 36 of a pivoted stop lever 35. When at rest against the stop surface 36, the positioning of the roller 34 a short distance past the dead center position of the cocking shaft with respect to the forces of the springs 11 is insured. When so cocked, the cocking shaft 24 may be released by rotating the stop lever 35 by means of the release shaft 37 and a lever fastened thereto (not shown) until the roller 34 slides off of the stop surface 36.

Stepwise rotation of the ratchet wheel 32 can be accomplished either by a motor which moves a thrust ratchet back and forth (not shown) or by hand motion of a plug-in rod (not shown) pushing on the cocking lever 40 on the cocking shaft 24.

When the cocking shaft 24 is unlatched, the force of the springs 11 is released and transmitted by a roller 41, carried on the crank arm 22 of the cocking shaft 24, to a rocker 42, and thence through adjustable coupling link 44 to the breaker shaft 43. The breaker shaft 43 extends the entire width of the supporting housing part 1, being journaled in the side walls 4 and 6. Rotation of the breaker shaft 43 is limited by stops 45 and 46, against which the levers 47 and 48, fastened to the breaker shaft 43, can come to rest. The lever 47 also is provided with a connecting post 50, which can be connected in a manner well known in the art to a drive rod for one of the pole columns of the power circuit breaker.

Figure 3:
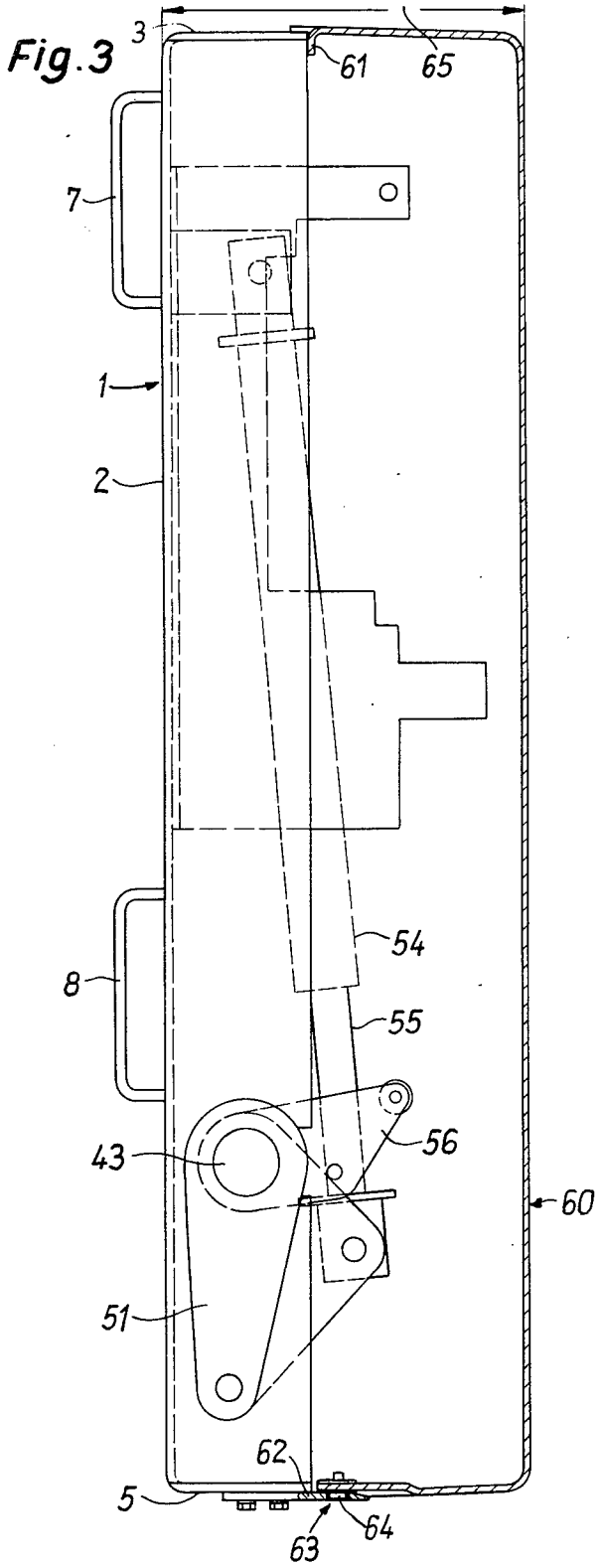
FIG. 3 is a side view of the driving apparatus of FIG. 1 including the covering hood, with part of the hood cut away.

The breaker shaft 43 carries another crank arm 51 which engages one end of an opening spring 52; the other end of spring 52 is braced against a stationary support 53 (see FIGS. 1 and 3). The opening spring 52, which is a coil spring working in compression, is supported by telescoping guide rods 54 and 55. The opening spring 52 is cocked during the above-described closing motion by rotation of the breaker shaft 43; it is held in the cocked condition by a latching arrangement on the breaker shaft 43. This latching arrangement consists of a roller lever 56 mounted on the breaker shaft 43 and a stop that can be released in the customary manner by an automatic tripping device or by hand.

The driving apparatus is capable of performing a so-called short interruption, i.e., the immediate switching sequence off-on-off. Thus, in the initial closed position, the opening springs 52 and the closing spring 11 are cocked, provision being made in a manner well known in the art for activation of the automatic cocking device immediately after the release of closing springs 11. The closing command can therefore be given immediately after a completed opening by actuating the release shaft 37, whereupon the breaker is closed while the opening spring 52 is cocked at the same time. Likewise immediately thereafter, the latching of the breaker shaft can be released, whereupon the breaker can open again.

The drive parts accommodated and supported in the support housing part 1 are covered, as shown in FIG. 3, by a hood 60, which may be made of a thin-walled metallic material or of a suitable plastic. At several points on the hood 60, portions of the wall of the hood are turned in to form lips or extensions 61 which bear against appropriate edges of the side walls of the supporting housing part 1 and so position the hood 60 on the housing part 1. Tabs 62, provided with openings 63, are attached to base 1; the openings 63 are adapted to receive and engage projections 64 arranged near the edge of the hood 60. The material of the hood 60 is elastically deformable in the areas of these projections 64 so that the hood 60 can be sprung onto the tabs 62. Other fastening means well known in the art may, of course, be provided.

As FIG. 3 best shows, the separation line between the supporting housing base or part 1 and the hood 60 is parallel to the bottom surface of the housing; the overall depth (indicated by the dimensioning arrow marked 65) of the driving apparatus housing is subdivided approximately in the ratio 1:2; i.e., about one-third of the depth is provided by the supporting housing part or base 1 and two-thirds of the depth by the hood. The supporting housing part thus provides only the strength necessary to accommodate the drive parts; the cover is a hood adapted for use as a cover only. With this construction of the supporting housing part, the drive parts protrude beyond the contours of the base so that they are highly accessible from all sides, facilitating the production assembly of the parts as well as later inspection and maintenance.

What is claimed is:

1. A driving apparatus for electric power circuit breakers comprising a shaft adapted for latching in a cocked condition, two crank arms axially spaced apart on the shaft and projecting oppositely 180° therefrom, each arm being coupled to a separate group of parallel-connected coil springs, a device for cocking the coil springs mounted on the shaft between the crank arms, means for taking the power output from one of the crank arms, and means on either side of the cocking device for supporting the shaft.

2. A driving apparatus according to claim 1 in which each group comprises four identical parallel-connected coil springs.

3. A driving apparatus according to claim 1 in which the coil springs are braced for compression between stationary springs and a linearly moving support connected by a tie rod to each of the crank arms.

4. A driving apparatus according to claim 1 further comprising a housing part having a support plane, the longitudinal axis of the coil spring groups being located at an acute angle to the support plane.

5. A driving apparatus for electric power circuit breakers comprising a cocking shaft, a cocking device mounted near the center of the shaft, support means for rotatably mounting said shaft disposed on either side of said cocking device, oppositely disposed crank arms attached to the shaft outboard of the support means and projecting outwardly from the shaft at a 180° angle to each other, a pair of movable spring supports each attached to the end of a crank arm by means of a tie rod, two groups of four parallel-connected coil springs disposed between stationary supports and the movable spring supports so that decompression of the springs releases accumulated power and drives the cocking shaft in rotation, latching means for maintaining the shaft in cocked condition, and means for taking energy released from the springs out of the shaft via one of the crank arms upon release of the cocking latch.

* * * * *